US006066191A

United States Patent [19]

Tanaka et al.

[11] Patent Number: 6,066,191

[45] Date of Patent: May 23, 2000

[54] HARD MOLYBDENUM ALLOY, WEAR RESISTANT ALLOY AND METHOD FOR MANUFACTURING THE SAME

[75] Inventors: Kouji Tanaka; Takashi Saito; Tadashi Oshima, all of Aichi, Japan

[73] Assignee: Kabushiki Kaisha Toyota Chuo Kenkyusho, Aichi-gun, Japan

[21] Appl. No.: 09/082,193

[22] Filed: May 21, 1998

[30] Foreign Application Priority Data

May 21, 1997 [JP] Japan ..... 9-148547

[51] Int. Cl.[7] ..... C22C 33/02; C22C 27/04

[52] U.S. Cl. ..... 75/246; 75/245; 419/1; 419/6; 420/429

[58] Field of Search ..... 420/429; 75/246, 75/245; 419/1, 6

[56] References Cited

U.S. PATENT DOCUMENTS

| | | | |
|---|---|---|---|
| 3,720,990 | 3/1973 | Larsen . | |
| 3,839,024 | 10/1974 | Demo, Jr. et al. . | |
| 3,841,724 | 10/1974 | Calabrese . | |
| 4,332,616 | 6/1982 | Morishita et al. | 75/243 |
| 4,552,590 | 11/1985 | Nakata et al. | 75/246 |
| 4,919,719 | 4/1990 | Abe et al. | 75/243 |
| 5,188,799 | 2/1993 | Mori et al. . | |
| 5,292,382 | 3/1994 | Longo . | |
| 5,298,052 | 3/1994 | Tanaka et al. | 75/243 |

OTHER PUBLICATIONS

Patent Abstracts of Japan, vol. 95, No. 7, Aug. 31, 1995, JP 7–090441, Apr. 4, 1995.

Database WPI, Derwent Publications, AN 78–77652, JP 53–035889, Sep. 29, 1978.

Patent Abstracts of Japan, vol. 96, No. 4, Apr. 30, 1996, JP 7–316703, Dec. 5, 1995.

*Primary Examiner*—Ngoclan Mai

*Attorney, Agent, or Firm*—Oblon, Spivak, McClelland, Maier & Neustadt, P.C.

[57] ABSTRACT

Disclosed is a hard molybdenum alloy which exhibits an excellent wear resistance against sliding wear and adhesive wear in a high temperature nonlubricating atmosphere, comprising at least one of nickel (Ni) and cobalt (Co) in an amount of from 14.0 to 43.0% by weight, silicon (Si) in an amount of from 3.0 to 8.0% by weight and molybdenum (Mo) in an amount of not less than 20.0% by weight. Also disclosed is a wear resistant alloy which includes the above hard molybdenum alloy as a reinforcing phase.

25 Claims, 8 Drawing Sheets

FIG 3. SCHEMATIC REPRESENTATION OF THE THRUST-COLLAR TYPE WEAR TESTER

RESULTS OF HIGH TEMPERATURE
FRICTIONAL WEAR TEST

RESULTS OF HIGH TEMPERATURE
FRICTIONAL WEAR TEST

HARD MOLYBDENUM ALLOY, WEAR RESISTANT ALLOY AND METHOD FOR MANUFACTURING THE SAME

FIELD OF THE INVENTION

The present invention relates to a hard molybdenum alloy, a wear resistant alloy and a method for manufacturing for these alloys. More particularly, the present invention relates to a hard molybdenum alloy having an excellent wear resistance, a hard molybdenum alloy material suitable for the enhancement of the wear resistance of metal, etc., and a method for manufacturing these.

BACKGROUND OF THE INVENTION

A metallic element such as molybdenum, niobium, tantalum and tungsten is known as an essential element of refractory metal which can be used at temperatures as high as not lower than 1,000° C. Among these metallic elements, molybdenum forms a Laves structure silicide with silicon and at least one element belonging to the group 8A such as nickel, cobalt and iron. The silicide is represented by the chemical formula $X_3Mo_2Si$ or XMoSi(in which X represents at least one element selected from the group consisting of nickel, cobalt, iron, etc.). As practical alloys containing such a silicide, there have been known Ni-base alloy and Co-base alloy described in "Wear and corrosion resistant alloy" (U.S. Pat. No. 3,839,024). These alloys are widely used for thermal spraying.

In recent years, for internal combustion engine, higher combustion efficiency, switching to substitute fuel, etc. have been keenly desired. To make those possible, mechanical parts constituting such an internal combustion engine must withstand even severer conditions of temperature, load and atmosphere.

However, the foregoing prior art alloys are disadvantageous in that they cannot meet these requirements. In particular, sliding mechanical parts are expected to withstand high temperature, nonlubricating and corrosive atmospheres at the same time, and the existing wear resistant materials become unfit for use more occasionally.

SUMMARY OF THE INVENTION

An object of the present invention is to provide a hard molybdenum alloy having an excellent wear resistance, a wear resistant alloy, and a method for the preparation thereof.

The inventors have paid their attention to the creation of a hard alloy comprising a Laves structure silicide as an essential constituent, rather than the conventional nickel alloy or cobalt alloy containing such a silicide. An experiment made it clear that a hard alloy having a desired structure and properties can be obtained by controlling the content of nickel and cobalt in the alloy within a predetermined range. The inventors have also conceived that for instance, a sintered alloy containing as a reinforcing phase, even in a small amount, said hard alloy which makes the best use of the excellent properties of Laves structure silicide exhibits a sufficient wear resistance in a high temperature nonlubricating atmosphere.

The hard molybdenum alloy according to the present invention comprises at least one of nickel (Ni) and cobalt (Co) in a total amount of from 14.0 to 43.0% by weight, silicon (Si) in an amount of from 3.0 to 8.0% by weight and molybdenum (Mo) in an amount of not less than 20.0% by weight based on the total weight of the hard molybdenum alloy.

The hard alloy according to the present invention exhibits an excellent wear resistance against abrasive wear, adhesive wear, etc. under a high temperature nonlubricating condition.

DETAILED DESCRIPTION OF THE INVENTION (Action)

Figure 1:
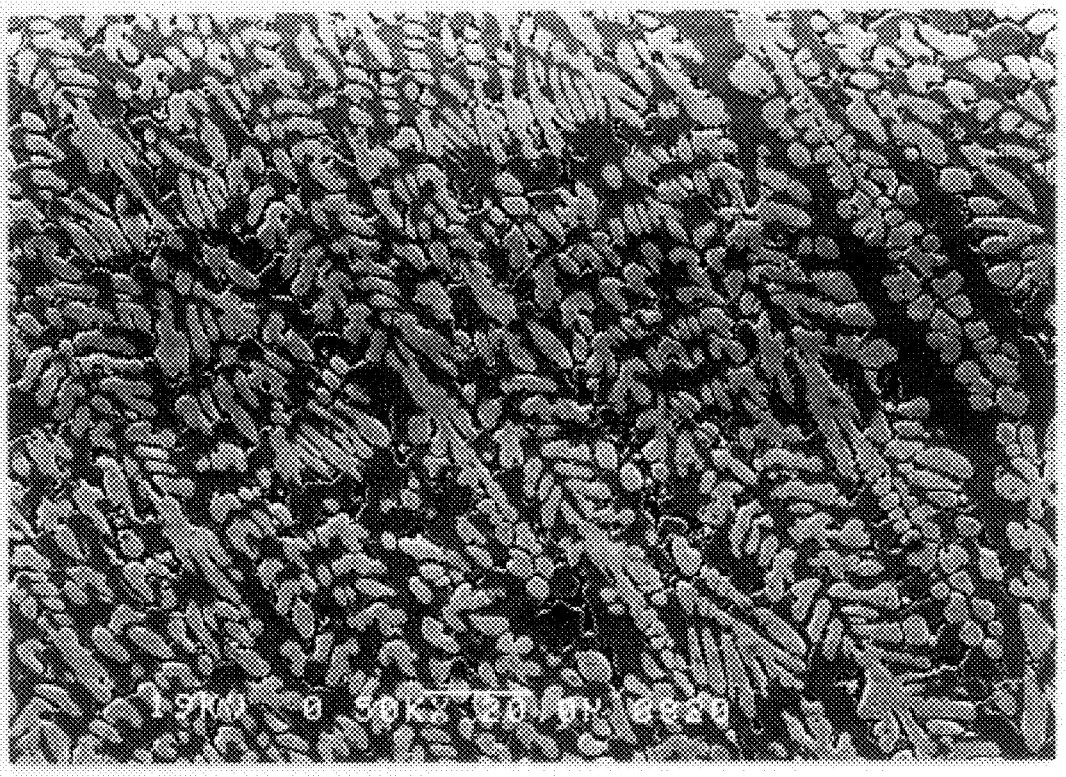
FIG. 1 is an optical microphotograph (magnification:× 580) of the microstructure of a section of the hard alloy k2 used in Example 1 according to the present invention.

The mechanism of the excellent effect of the hard molybdenum alloy of the present invention is not yet made clear but can be thought as follows.

The hard alloy according to the present invention comprises at least one of nickel (Ni) and cobalt (Co) in an amount of from 14.0 to 43.0% by weight, silicon (Si) in an amount of from 3.0 to 8.0% by weight and molybdenum (Mo) in an amount of not less than 20.0% by weight based on the total weight of the hard molybdenum alloy.

Mo

Molybdenum (Mo) is incorporated in the hard alloy in an amount of not less than 20.0% by weight. Mo in the hard alloy of the present invention is an essential element constituting Laves structure silicide. Mo is a main element in the remainder part of the alloy other than alloying elements described below. It is incorporated in the alloy in an amount of at least 20% by weight. The incorporation of Mo in an amount falling within the above defined range makes it possible for the hard alloy of the present invention to comprise Laves structure silicide as a main constituent element in its microstructure. The silicide can play a most active part in exhibiting wear resistance in a high temperature nonlubricating condition due to its self-lubrication.

If the content of Mo falls below 20.0% by weight, Mo cannot constitute the Laves structure silicide in an amount large enough for the objective, regardless of the content of other essential constituent elements of the silicide. As a result, the volume percentage of the desired silicide in the hard alloy is less than 20 vol-%, making it impossible for the hard alloy to attain sufficient wear resistance by the foregoing mechanism.

Ni, Co

At least one of nickel (Ni) and cobalt (Co) is incorporated in the alloy in a total amount of from 14.0% by weight to 43.0% by weight. Ni and Co enter into the silicide made of Mo and Si to stabilize the Laves structure. In this sense, Ni and Co are essential elements. Ni and Co are also elements which form a solid solution binding phase surrounding the Laves structure silicide.

If the total amount of at least one of Ni and Co falls below 14.0% by weight, Ni and Co cannot constitute the Laves structure silicide in an amount large enough for the objective, regardless of the content of other essential constituent elements of the silicide. As a result, the volume percentage of the desired silicide in the hard alloy is not more than 20 vol-%, causing the same problems as mentioned above. On the contrary, if the total amount of at least one of Ni and Co exceeds 43.0% by weight, the content of Mo in the remainder of the alloy is relatively small. As a result, the content of Laves structure silicide is reduced. Additionally or alternatively, excess Ni and Co absorb Si in the solid solution binding phase, thereby making the binding phase brittle, and hence they tend to cause falling off and have an adverse effect on the sliding properties.

Si

Silicon (Si) is incorporated in the alloy in an amount of from 3.0% by weight to 8.0% by weight. Si is bonded preferentially to Mo and thus is another essential element of the Laves structure silicide.

If the content of Si falls below 3.0% by weight, Si cannot constitute the Laves structure silicide, in an amount large enough for the objective, regardless of the content of other essential constituent elements of the silicide. As a result, the volume percentage of the desired silicide in the hard alloy is not more than 20 vol-%, causing the same problems as mentioned above. On the contrary, if the content of Si exceeds 8.0% by weight, Si which has been left of the Laves structure silicide enters into the solid solution binding phase, thereby making the binding phase brittle, as mentioned above.

<Appropriate Si content>

Si preferably satisfies the following relationship with Mo in content as calculated in terms of weight fraction:

5.5<Mo/Si

As mentioned above, the Laves structure silicide requires that Mo and Si are bonded to each other by a strong affinity in a predetermined proportion. Even if the content of Si is not more than 8.0% by weight, when Mo/Si ratio is falling out of the above mentioned range, it is likely that the foregoing solid solution binding phase can be embrittled. In other words, when Mo/Si ratio falls within the above mentioned range, the embrittlement of the binding phase can be prevented to advantage.

Hard Molybdenum Alloy

The hard molybdenum alloy of the present invention comprises at least one of nickel (Ni) and cobalt (Co), silicon (Si) and molybdenum (Mo) in amounts falling within the above defined range.

The microstructure of the hard molybdenum alloy is mainly composed of a Laves structure silicide and a solid solution binding phase made of Ni, Co, etc. Among these constituents, the Laves structure silicide, which is a main constituent, is a silicide in which Mo and Si, attract elements such as Ni, Co, Fe, Cr and Cu to form a Laves crystal structure represented by the chemical formula $X_3Mo_2Si$ or XMoSi(in which X represents at least one element selected from the group consisting of nickel, cobalt, iron, chromium, copper, etc.). When exposed to high temperatures, the silicide forms on the surface thereof an adhesive molybdenum oxide which collects an oxide scale or the like developed on the mating material surface, and prevents its direct metal contact with the mating material. As a result, wear caused by chemical metal bond to the surface of the mating material, particularly at high temperatures, can be remarkably inhibited.

Further, by controlling the content of Ni and Co in the alloy within a predetermined range, the amount of a Laves structure silicide can be increased in an amount of at least 20 vol-%, and the solid solution binding phase surrounding the silicide can be toughened, making it possible to drastically improve the sliding properties of the alloy.

Thus, it is thought that the hard alloy of the present invention exerts the foregoing synergistic effect to exhibit a high resistance against wear under high temperature nonlubricating conditions.

Inventions embodying the foregoing invention, other inventions, and embodiments of these inventions will be further described hereinafter.

In recent years, for internal combustion engine, higher combustion efficiency, switching to substitute fuel, etc. have been keenly desired. To make those possible, mechanical parts constituting such an internal combustion engine must withstand even severer conditions of temperature, load and atmosphere. In particular, sliding mechanical parts are expected to withstand high temperature, nonlubricating and corrosive conditions at the same time, and the existing wear resistant materials become unfit for use more occasionally.

For the parts which are subject to sliding wear and adhesive wear at the same time, a Laves structure silicide has very attractive properties as mentioned above. There are the following three possible methods of utilizing such a hard phase to improve the wear resistance of mechanical parts:

1) A method which comprises manufacturing parts from a bulked material obtained by subjecting a hard alloy containing the hard phase singly to casting, powder metallurgy or the like;

2) A method which comprises preparing the hard alloy singly in powder form, and then applying the powder to the surface of parts by cladding, thermal spraying or the like; and 3) A method which comprises preparing the hard alloy in the form of powder, fiber, foil or the like, combining other metal-base matrixes with the hard alloy as a reinforcing phase, and then manufacturing parts from the obtained composite.

Among these methods, the combining method described in the method (3) can be accomplished by any method such as sintering, insert, infiltration, cladding and thermal spraying. In many cases, however, the amount of the reinforcing phase to be incorporated cannot be increased so much from the standpoint of productivity. In particular, for the preparation of a sintered alloy which is often used for sliding parts, a starting material powder comprising a large amount of a reinforcing phase incorporated therein is poor both in compactibility and sinterability. In order to densify such a starting material powder, the production cost must be raised.

Thus, the amount of such a reinforcing phase to be incorporated is preferably as small as possible. Accordingly, a high performance hard alloy is required which exhibits an effectively improved wear resistance even if it is incorporated in a limited amount as a reinforcing phase, not to mention when used as a single alloy material.

In the light of the possible working conditions under which the foregoing future sliding mechanical parts are used, the inventors made extensive studies for providing a hard alloy which makes the best use of excellent properties of a Laves structure silicide to drastically widen the application of wear resistant alloys to be used under the foregoing conditions, and for providing a wear resistant alloy comprising such a hard alloy as a reinforcing phase. The inventors also made various systematic experiments. The present invention has been thus worked out.

The inventors have paid their attention to the creation of a hard alloy comprising a Laves structure silicide as an essential constituent, rather than the conventional nickel alloy or cobalt alloy containing such a silicide. An experiment made it clear that a hard alloy having a desired structure and properties can be obtained by controlling the content of nickel and cobalt in the alloy within a predetermined range. The inventors have also conceived that an alloy containing as a reinforcing phase a hard alloy which makes the best use of the excellent properties of a Laves structure silicide even in a small amount exhibits a sufficient wear resistance under a high temperature nonlubricating condition.

First Embodiment

The hard molybdenum alloy according to the first embodiment of the present invention comprises at least one of nickel (Ni) and cobalt (Co) in a total amount of from 14.0 to 43.0% by weight, silicon (Si) in an amount of from 3.0 to 8.0% by weight, molybdenum (Mo) in an amount of not less than 20.0% by weight, and at least one element selected from the group consisting of tungsten (W), niobium (Nb), vanadium (V), hafnium (Hf) and tantalum (Ta) in a total amount of not more than 50.0% by weight of the remainder of the alloy excluding the foregoing elements other than Mo.

The hard molybdenum alloy of the present invention exhibits wear resistance under a high temperature nonlubricating condition, as well as excellent corrosion resistance and oxidation resistance, particularly in a high temperature corrosive atmosphere.

The excellent effects of the hard molybdenum alloy of the present invention is mainly attributed to the Laves structure silicide, which is a constituent of the microstructure, as mentioned above. W, Nb, V, Hf and Ta, which feature the first embodiment of the present invention, are elements akin to Mo in properties as obvious from the fact that these elements are essential elements of refractory metal similarly to Mo. Thus, in the Laves structure-silicide, these elements can substitute for Mo to some extent, and enhance the hardness of the silicide without drastically changing its physical and chemical properties. These elements remarkably improve corrosion resistance and oxidation resistance and thus effectively inhibit the deterioration of materials in a high temperature corrosive atmosphere.

W, Nb, V, Hf, Ta

In the hard molybdenum alloy of the first embodiment of the present invention, the total content of at least one element selected from the group consisting of W, Nb, V, Hf and Ta is not more than 50% by weight of the remainder of the alloy excluding elements other than Mo. If the total content of W, Nb, V, Hf and Ta exceeds 50% by weight of the remainder, the Laves structure silicide is subject to change of crystal structure, possibly causing a loss of self-lubrication inherent to the foregoing silicide which is effective for high temperature wear resistance.

Second Embodiment

The hard molybdenum alloy according to the second embodiment of the present invention comprises at least one of nickel (Ni) and cobalt (Co) in an amount of from 14.0% by weight to 43.0% by weight, silicon (Si) in an amount of from 3.0% by weight to 8.0% by weight, at least one of iron (Fe), copper (Cu) and chromium (Cr) in an amount of from 5.0% by weight to 55.0% by weight, and molybdenum (Mo) in an amount of not less than 20.0% by weight.

The hard molybdenum alloy of the second embodiment of the present invention can provide a hard material which exhibits an excellent wear resistance against sliding wear and adhesive wear under a high temperature nonlubricating condition, and exhibits mechanical properties having well-balanced hardness and toughness as a single alloying material.

The excellent effects of the hard molybdenum alloy of the present invention are mainly attributed to the Laves structure silicide, which is a constituent of the microstructure, as mentioned above. Fe, Cu, and Cr, which feature the second embodiment of the present invention, are elements which can substitute for Ni and Co to a predetermined extent and form preferentially a solid solution binding phase binding the Laves structure silicide without drastically changing the crystalline structure and chemical properties of the Laves structure silicide. Accordingly, Fe, Cu and Cr can be incorporated in the alloy while controlling the content of Ni and Co to an extent such that it doesn't go so far beyond the value required for the produced amount of Laves structure silicide expected from the content of Mo, Si, etc. As mentioned above, Ni and Co, if incorporated excessively, absorb Si and make the binding phase brittle. To the contrary, Fe, Cu and Cr are less likely to absorb Si than Ni and Co and thus can provide the binding phase with a proper toughness.

Fe, Cu, Cr

The content of at least one of Fe, Cu and Cr in the hard molybdenum alloy of the present invention is from 5.0% by weight to 55.0% by weight. If the total content of at least one of Fe, Cu and Cr falls below 5.0% by weight, these elements are consumed only in the substitution for Ni and Co in the Laves structure silicide, and little effects on the solid solution binding phase can be obtained. On the contrary, if the total content of at least one of Fe, Cu and Cr exceeds 55.0% by weight, the produced amount of the binding phase is remarkably greater than that of Laves structure silicide, possibly making it impossible to provide the hard molybdenum alloy with satisfactory wear resistance.

Third Embodiment

The hard molybdenum alloy of the third embodiment of the present invention comprises at least one of nickel (Ni) and cobalt (Co) in a total amount of from 14.0% by weight to 43.0% by weight, silicon (Si) in an amount of from 3.0% by weight to 8.0% by weight, at least one of iron (Fe), copper (Cu) and chromium (Cr) in a total amount of from 5.0% by weight to 55.0% by weight, molybdenum (Mo) in an amount of not less than 20.0% by weight, and at least one element selected from the group consisting of tungsten (W), niobium (Nb), vanadium (V), hafnium (Hf) and tantalum (Ta) in a total amount of not more than 50.0% by weight of the remainder of the alloy excluding the foregoing elements other than Mo.

The hard molybdenum alloy of the third embodiment of the present invention exhibits wear resistance in a high temperature nonlubricating condition, as well as corrosion resistance and oxidation resistance, particularly in a high temperature corrosive atmosphere. The synergistic combination of the effect of Fe, Cu and Cr and the effect of W, Nb, V, Hf and Ta makes it possible to provide a hard alloy of great utility which exhibits a high temperature wear resistance as well as practically important mechanical properties and corrosive resistance.

The excellent effects of the hard molybdenum alloy of the present invention is mainly attributed to the Laves structure silicide, which is a constituent of the microstructure, as mentioned above.

W, Nb, V, Hf, Ta

In the hard molybdenum alloy of the third embodiment of the present invention, the total content of at least one element selected from the group consisting of W, Nb, V, Hf and Ta is not more than 50% by weight of the remainder of the alloy excluding elements other than Mo. If the total content of W, Nb, V, Hf and Ta exceeds 50% by weight of the remainder, the Laves structure silicide is subject to change of crystal structure, possibly causing a loss of self-lubrication inherent to the foregoing silicide which is effective for high temperature wear resistance.

Fe, Cu, Cr

The content of at least one of Fe, Cu and Cr in the hard molybdenum alloy of the third embodiment of the present invention is from 5.0% by weight to 55.0% by weight. If the total content of at least one of Fe, Cu and Cr falls below 5.0% by weight, since the substitution for Ni and Co by these elements in the Laves structure silicide occurs preferentially to the formation of solid solution binding phase, little effects on the solid solution binding phase can be obtained. On the contrary, if the total content of at least one of Fe, Cu and Cr exceeds 55.0% by weight, the produced amount of the binding phase is remarkably greater than that of Laves structure silicide, possibly making it impossible to provide satisfactory wear resistance.

Thus, the hard molybdenum alloy of the third embodiment of the present invention exhibits wear resistance in a high temperature nonlubricating condition, as well as excellent corrosion resistance and oxidation resistance, particularly in a high temperature corrosive atmosphere. At the same time, the synergistic combination of the effect of Fe, Cu and Cr and the effect of W, Nb, V, Hf and Ta makes it possible to provide a hard alloy of great utility which exhibits a high temperature wear resistance as well as practically important mechanical properties and corrosion resistance.

Preferred Embodiments of the Invention and the First to Third Embodiments of the Invention Mo The preferred content of Mo in the hard molybdenum alloy of the present invention is from 25.0% by weight to 70.0% by weight. By controlling the content of Mo within this range, a hard molybdenum alloy having a better wear resistance can be provided. In addition, by satisfying the following preferred content of Ni, Co and Si, the volume percent of Laves structure silicide in the hard alloy can be controlled to not less than 60 vol-%.

The content of Mo in the hard molybdenum alloy of the present invention is more preferably from 30.0% by weight to 50.0% by weight. By controlling the content of Mo within this range, a hard molybdenum alloy having a better wear resistance can be provided. In addition, by satisfying the following more preferred content of Ni, Co and Si, the volume percent of Laves structure silicide in the hard alloy can be controlled to not less than 80 vol-%.

Ni, Co

The preferred total content of at least one of Ni and Co in the hard molybdenum alloy of the present invention is from 20.0% by weight to 40.0% by weight. By controlling the total content of at least one of Ni and Co within this range while satisfying the foregoing preferred Mo content and the following preferred Si content, the volume percent of Laves structure silicide in the hard alloy can be controlled to not less than 60 vol-%.

The total content of at least one of Ni and Co in the hard molybdenum alloy of the present invention is more preferably from 26.0% by weight to 38.0% by weight. By controlling the total content of at least one of Ni and Co within this range while satisfying the foregoing more preferred Mo content and the following more preferred Si content, the volume percent of Laves structure silicide in the hard alloy can be controlled to not less than 80 vol-% to advantage.

Si

The preferred content of Si in the hard molybdenum alloy of the present invention is from 4.0% by weight to 6.5% by weight. By controlling the content of Si within this range, the resulting binding phase can be provided with assured toughness to advantage. In addition, by satisfying the preferred content of Mo, Ni and Co, the volume percent of Laves structure silicide in the hard alloy can be controlled to not less than 60 vol-%.

The content of Si in the hard molybdenum alloy of the present invention is more preferably from 4.5% by weight to 6.2% by weight. By controlling the content of Si within this range, the resulting binding phase can be provided with assured toughness to advantage. In addition, by satisfying the more preferred content of Mo, Ni and Co, the volume percent of Laves structure silicide in the hard alloy can be controlled to not less than 80 vol-%.

Fe, Cu, Cr

The preferred content of at least one of Fe, Cu and Cr in the hard molybdenum alloy of the present invention is from 10.0% by weight to 33.0% by weight. By controlling the content of at least one of Fe, Cu and Cr within this range, a hard alloy having a solid solution binding phase with higher toughness can be provided. In addition, by satisfying the foregoing preferred content of Mo, Ni, Co and Si, a hard alloy comprising a Laves structure silicide in an amount of not less than 60 vol-% and a solid solution binding phase with higher toughness can be provided.

The content of at least one of Fe, Cu and Cr in the hard molybdenum alloy of the present invention is more preferably from 12.0% by weight to 25.0% by weight. By controlling the content of at least one of Fe, Cu and Cr within this range, a hard alloy having a solid solution binding phase excellent in toughness can be provided. In addition, by satisfying the foregoing more preferred content of Mo, Ni, Co and Si, a hard alloy comprising a Laves structure silicide in an amount of not less than 80 vol-% and a solid solution binding phase having an excellent toughness can be provided.

Shape of Hard Alloy

The shape of the hard molybdenum alloy of the present invention is not limited but may be properly selected from the group consisting of bulk, powder, foil and fiber, etc. depending on the purpose.

Fourth Embodiment

The fourth embodiment of present invention concerns a wear resistant alloy comprising the foregoing hard molybdenum alloy of the present invention (including the first to third embodiments and preferred embodiments thereof; hereinafter simply referred to as "hard alloy") incorporated in the metallic matrix as a reinforcing phase.

The wear resistant alloy of the fourth embodiment of the present invention exhibits an excellent wear resistance against sliding wear and adhesive wear under a high temperature nonlubricating condition.

The mechanism of the excellent effect of the wear resistant alloy of the present invention is not yet made clear but can be thought as follows.

The excellent wear resistance of the alloy of the present invention is attributed to the Laves structure silicide in the hard molybdenum alloy incorporated as a reinforcing phase in the metallic matrix. This effect is almost the same as that described with reference to the foregoing hard molybdenum alloy of the present invention. In the present wear resistant alloy, the hard alloy exposed on the surface which comes in contact with the mating material exhibits a high wear resistance as mentioned above. Therefore, the present wear resistant alloy acts to remarkably retard the progress of wear of the entire alloy as compared with an alloy comprising a metallic matrix alone.

<Hard Alloy>

Mo In Hard Alloy

The content of molybdenum (Mo) in the hard alloy to be incorporated in the wear resistant alloy of the fourth embodiment of the present invention is not less than 20.0% by weight. Mo is an essential main element of the Laves structure silicide in the hard alloy and is incorporated in the alloy in an amount of at least 20% by weight. The incorporation of Mo in an amount falling within the above defined range makes it possible for the hard alloy of the present invention to have a large amount of Laves structure silicide formed in its structure. The silicide thus formed can play a most active part in exhibiting wear resistance under a high temperature nonlubricating condition due to its self-lubrication. If the content of Mo falls below 20.0% by weight, Mo cannot constitute the Laves structure silicide in an amount large enough for the objective, regardless of the content of other essential constituent elements of the silicide. As a result, the volume percentage of the desired silicide in the hard alloy is not more than 20 vol-%, making it impossible for the hard alloy to attain sufficient wear resistance by the foregoing mechanism. In order to give assured wear resistance by incorporating such hard alloy as a reinforcing phase, it is necessary to incorporate a large amount of the hard alloy in the metallic matrix. In the case where the metallic matrix is combined with a large amount of the hard alloy, problems unavoidably occur in production regardless of method such as sintering, insert, infiltration, cladding and thermal spraying.

The preferred content of Mo in the hard alloy incorporated in the wear resistant alloy of the fourth embodiment of the present invention is from 25.0% by weight to 70.0% by weight. By controlling the content of Mo within this range, a hard molybdenum alloy having a higher wear resistance can be provided. In addition, by satisfying the preferred content of Ni, Co and Si, the volume percent of Laves structure silicide in the hard alloy can be controlled to not less than 60 vol-%. As a result, if the hard alloy is incorporated in other metallic matrixes as a reinforcing phase, the wear resistance under high temperature nonlubricating conditions can be improved even if Vf (volume fraction) of the hard alloy is not more than 0.3. If Vf of the hard alloy can be reduced to not more than 0.3, the coalescence of the hard phase due to agglomeration and cohesion can be inhibited in a method involving the use of molten metallic matrix such as insert, infiltration, cladding and thermal spraying. Accordingly, the occurrence of resulting defects caused by the coalescence such as cracking, residual void and cavity can be inhibited.

The content of Mo in the hard alloy incorporated in the wear resistant alloy of the fourth embodiment of the present invention is more preferably from 30.0% by weight to 50.0% by weight. By controlling the content of Mo within this range, a hard molybdenum alloy having excellent wear resistance can be provided. In addition, by satisfying the following more preferred content of Ni, Co and Si, the volume percent of Laves structure silicide in the hard alloy can be controlled to not less than 80 vol-%. As a result, if the hard alloy is incorporated in other metallic matrixes as a reinforcing phase, the wear resistance of the resulting alloy under high temperature nonlubricating conditions can be improved even when Vf is not more than 0.15. If Vf of the hard alloy can be reduced to not more than 0.15, it is not necessary to exert high pressure for densification during sintering or infiltration, thereby making it possible to use simple production facilities to advantage.

Ni, Co In Hard Alloy

In the hard alloy to be incorporated in the wear resistant alloy of the fourth embodiment of the present invention, at least one of Nickel (Ni) and cobalt (Co) is incorporated in an amount of from 14.0% by weight to 43.0% by weight. Ni and Co enter into the silicide made of Mo and Si to stabilize the Laves structure. In this sense, Ni and Co are essential elements. Ni and Co are also main elements which form a solid solution binding phase surrounding the Laves structure silicide.

If the total amount of at least one of Ni and Co falls below 14.0% by weight, Ni and Co cannot constitute the Laves structure silicide in an amount large enough for the objective, regardless of the content of other essential constituent elements of the silicide. As a result, the volume percent of the desired silicide in the hard alloy is not more than 20 vol-%, causing the same problems as mentioned above. On the contrary, if the total amount of at least one of Ni and Co exceeds 43.0% by weight, the content of Mo in the remainder of the alloy is relatively small. As a result, the content of Laves structure silicide is reduced. Additionally or alternatively, excess Ni and Co absorb Si in the solid solution binding phase, thereby making the binding phase brittle and hence have an adverse effect on the sliding properties.

The preferred total content of at least one of Ni and Co in the hard alloy incorporated in the wear resistant alloy of the present invention is from 20.0% by weight to 40.0% by weight. By controlling the total content of at least one of Ni and Co within this range while satisfying the foregoing preferred Mo content and the following preferred Si content, the volume percent of Laves structure silicide in the hard alloy can be controlled to not less than 60 vol-%, and when the hard alloy is incorporated in other metallic matrixes as a reinforcing phase, Vf of the hard alloy can be reduced to not more than 0.3 to advantage.

The total content of at least one of Ni and Co in the hard alloy to be incorporated in the wear resistant alloy of the fourth embodiment of the present invention is more preferably from 26.0% by weight to 38.0% by weight. By controlling the total content of at least one of Ni and Co within this range while satisfying the foregoing more preferred Mo content and the following preferred Si content, the volume percent of Laves structure silicide in the hard alloy can be controlled to not less than 80 vol-%, and when the hard alloy is incorporated in other metallic matrixes as a reinforcing phase, Vf of the hard alloy can be reduced to not more than 0.15 to advantage.

Si In Hard Alloy

Silicon (Si) is incorporated in the hard alloy in an amount of from 3.0% by weight to 8.0% by weight. Si is bonded preferentially to Mo and thus is another essential element of the Laves structure silicide. If the content of Si falls below 3.0% by weight, Si cannot constitute the Laves structure silicide in an amount large enough for the objective, regardless of the content of other essential constituent elements of the silicide. As a result, the volume percent of the desired silicide in the hard alloy is not more than 20 vol-%, causing the same problems as mentioned above. On the contrary, if the content of Si exceeds 8.0% by weight, the excess Si which has been left of the Laves structure silicide enters into the solid solution binding phase to make the binding phase brittle as mentioned above.

The preferred content of Si in the hard alloy incorporated in the wear resistant alloy of the fourth embodiment of the present invention is from 4.0% by weight to 6.5% by weight. By controlling the content of Si within this range, the resulting binding phase can be provided with assured toughness to advantage. In addition, by satisfying the preferred content of Mo, Ni and Co, the volume percent of Laves structure silicide in the hard alloy can be controlled to not less than 60 vol-%, and when the hard alloy is incorporated in other metallic matrixes as a reinforcing phase, Vf of the hard alloy can be reduced to not more than 0.3 to advantage.

The content of Si in the hard alloy incorporated in the wear resistant alloy of the present invention is more preferably from 4.5% by weight to 6.2% by weight. By controlling the content of Si within this range, the resulting binding phase can be provided with assured toughness to advantage. In addition, by satisfying the more preferred content of Mo, Ni and Co, the volume percent of Laves structure silicide in the hard alloy can be controlled to not less than 80 vol-%, and when the hard alloy is incorporated in other metallic matrixes as a reinforcing phase, Vf of the hard alloy can be reduced to not more than 0.15 to advantage.

Fe, Cu and Cr In Hard Alloy

The content of at least one of Fe, Cu and Cr in the hard alloy incorporated in the wear resistant alloy of the fourth embodiment of the present invention is from 5.0% by weight to 55.0% by weight. If the total content of at least one of Fe, Cu and Cr falls below 5.0% by weight, the substitution for Ni and Co by these elements in the Laves structure silicide is effected preferentially to the formation of solid solution binding phase, exerting little effects on the solid solution binding phase. On the contrary, if the total content of at least one of Fe, Cu and Cr exceeds 55.0% by weight, the produced amount of the binding phase is remarkably greater than that of Laves structure silicide, possibly making it impossible to provide the hard molybdenum alloy as a reinforcing phase with satisfactory wear resistance.

The preferred content of at least one of Fe, Cu and Cr in the hard alloy incorporated in the wear resistant alloy of the fourth embodiment of the present invention is from 10.0% by weight to 33.0% by weight. By controlling the content of at least one of Fe, Cu and Cr within this range, a hard alloy having a solid solution binding phase with higher toughness can be provided. In addition, by satisfying the foregoing preferred content of Mo, Ni, Co and Si, a hard alloy comprising a Laves structure silicide in an amount of not less than 60 vol-% and a-solid solution binding phase having higher toughness can be provided.

The content of at least one of Fe, Cu and Cr in the hard alloy incorporated in the wear resistant alloy of the fourth embodiment of the present invention is more preferably from 12.0% by weight to 25.0% by weight. By controlling the content of at least one of Fe, Cu and Cr within this range, a hard alloy having a solid solution binding phase with excellent toughness can be provided. In addition, by satisfying the foregoing more preferred content of Mo, Ni, Co and Si, a hard alloy comprising a Laves structure silicide in an amount of not less than 80 vol-% and a solid solution binding phase having an excellent toughness can be provided.

Shape Of Hard Alloy

The shape of the hard alloy to be incorporated in the wear resistant alloy of the fourth embodiment of the present invention is not limited but may be properly selected from the group consisting of bulk, powder, foil and fiber so far as it is suitable for combining with the metallic matrix.

<Metallic Matrix>

The metallic matrix to be incorporated in the wear resistant alloy of the fourth embodiment of the present invention may be made of iron-, copper-, nickel-based alloys or the like.

Generally, the wear resistance of an alloy containing a reinforcing phase is greatly affected by the shape and size of the reinforcing phase. The hard alloy of the present invention mainly composed of a Laves structure silicide is thermodynamically stable in any metallic matrix. Thus, reaction can hardly occur at the interface between the hard alloy and the metal-base matrix such as iron-, copper-, nickel-based alloys and the like. Accordingly, the desired reinforcing phase-dispersed structure can be easily obtained without a drastic change of the prepared shape of the reinforcing phase.

<Manufacturing method: Combining Method>

The method for manufacturing the wear resistant alloy of the fourth embodiment of the present invention is not specifically limited. In practice, the following methods may be employed. Namely, as the method for combining the hard alloy with the metallic matrix, there may be selected from methods for manufacturing ordinary composite materials such as sintering, insert, infiltration, cladding and thermal spraying depending on the kind of the metallic matrix used.

Blended Amount

The amount of the hard alloy to be incorporated as a reinforcing phase in the wear resistant alloy of the fourth embodiment of the present invention is not specifically limited. In practice, however, it is preferably from 0.03 to 0.95, more preferably from 0.05 to 0.7 as calculated in terms of volume fraction (Vf). If Vf of the hard alloy falls below 0.05, the foregoing wear resistance cannot sufficiently be attained. On the contrary, if Vf of the hard alloy exceeds 0.7, countermeasures against agglomeration and cohesion of hard phase and/or treatment under high temperature and high pressure conditions during the combining step may become necessary. Further, if Vf exceeds 0.95, the role of the metallic matrixes is substantially diminished.

In the wear resistant alloy of the fourth embodiment of the present invention, the hard alloy may be dispersed entirely or in specific sites in the metallic matrix or dispersed in different amounts depending on the site. The amount of the hard alloy to be incorporated is properly selected depending on the purpose.

Fifth Embodiment

The fifth embodiment of the present invention concerns a wear resistant sintered alloy which is obtained by sintering a mixture of the foregoing hard molybdenum alloy of the present invention and a metallic matrix powder or a blended elemental powder constituting the metallic matrix so that the hard alloy is incorporated as a reinforcing phase in the metallic matrix.

The wear resistant sintered alloy of the fifth embodiment of the present invention exhibits an excellent wear resistance against sliding wear and adhesive wear under a high temperature nonlubricating condition.

The mechanism of the excellent effect of the wear resistant sintered alloy of the present invention is not yet made clear but can be thought as follows.

The mechanism of the excellent effects of the wear resistant sintered alloy of the fifth embodiment of the present invention is almost the same as that described with reference to the foregoing hard molybdenum alloy of the present invention (including the first to third embodiments and preferred embodiments thereof) and the foregoing wear resistant alloy (fourth embodiment). In the present wear resistant sintered alloy, the hard alloy exposed on the surface which comes in contact with the mating material exhibits a high wear resistance as mentioned above. Therefore, the present wear resistant sintered alloy acts to remarkably retard the progress of wear of the entire alloy as compared with an alloy comprising a metallic matrix alone.

In the fifth embodiment, as the hard alloy powder to be incorporated in the wear resistant sintered alloy there may be used the powder of the hard alloy described with reference to the wear resistant alloy according to the foregoing fourth embodiment. The hard alloy to be incorporated in the wear resistant sintered alloy of the fifth embodiment of the present invention is preferably supplied in the form of powder having a grain size of from 20 to 200 $\mu$m on the average, because the grain size of the hard phase in the wear resistant sintered alloy succeeds to that of the starting powder, and the range of about 20 to 200 $\mu$m is suitable for the size of the hard phase in view of wear resistance. The powder shape depends on the preparation method and is not specifically limited.

In the fifth embodiment, as the powder for forming the metallic matrix of the wear resistant sintered alloy, there my be used the metallic matrix powder or a blended elemental powder constituting the metallic matrix described with reference to the wear resistant alloy according to the fourth embodiment. The matrix-forming powder to be incorporated in the wear resistant sintered alloy of the fifth embodiment of the present invention has no specific limitation in grain size distribution. However, it is preferably supplied in the form of powder having a grain size capable of being densified by sintering, e.g., of from 3 to 200 $\mu$m. The powder shape is not specifically limited.

The amount of the hard alloy to be incorporated as a reinforcing phase in the wear resistant sintered alloy according to the fifth embodiment is not specifically limited. In practice, however, it is preferably from 0.05 to 0.7 as calculated in terms of volume fraction (Vf). If Vf of the hard alloy falls below 0.05, the foregoing wear resistance cannot sufficiently be attained. On the contrary, if Vf of the hard alloy exceeds 0.7, the use of high temperature liquid phase sintering or high pressure sintering at the sintering step may become necessary. Further, in order to increase the sintering density of the wear resistant sintered alloy, boron (B) or carbon (C) may be added in the form of mixture with either the hard alloy powder or metallic matrix-forming powder in an amount of not more than 2% based on the total amount of the sintered alloy. Boron or carbon may partly be bonded to Mo, W, Nb, Ta, Hf or the like element constituting the hard phase to form a hard compound such as boride or carbide. Accordingly, these elements have an effect of further increasing the wear resistance. If the content of boron or carbon exceeds 2%, however, Mo is undesirably consumed to form a molybdenum boride or carbide, instead of forming a Laves structure silicide.

In the wear resistant sintered alloy according to the fifth embodiment, the preparation of a mixture of the hard alloy powder and the metallic matrix-forming powder may be accomplished by mixing these two powders by means of a commonly used apparatus such as V blender, ball mill and attritor, and then forming the mixture under pressure by means of a die press, hydrostatic press or the like.

The sintering may be effected under conditions depending on the kind of the metallic powder used. In practice, however, it is preferably effected in a reducing or nonoxidizing atmosphere such as hydrogen, argon and vacuum. In some cases, pressing and sintering may be effected at the same time, e.g., hot pressing or hot isostatic pressing and plasma-discharged sintering. Alternatively, the mixture thus sintered may be subjected to hot working. In this manner, the mixture can be densified.

The examples of the present invention will be described hereinafter.

EXAMPLE 1

Hard Alloy

An electrolytic copper, an electrolytic nickel, cobalt, an electrolytic iron, a copper-chromium alloy, an iron-molybdenum alloy and silicon each having a purity of not less than 99% by weight were blended in various formulations as set forth in Table 1. The mixtures were each then subjected to gas atomizing process to prepare hard molybdenum alloys k1 to k3 of Example 1 according to the present invention in powder form. The melted amount of these alloys were each about 8 kg. These alloys were each melted by high frequency induction heating to form a fine molten metal stream which ran towards a spraying tank where it was then attacked by a high pressure nitrogen gas so that it was atomized.

TABLE 1

| Specimen | Alloy element concentration (wt-%) | Laves phase proportion | Macroscopic hardness |
|---|---|---|---|

| | No. | Co | Ni | Mo | Fe | Cu | Cr | Si | (volume %) | (Hv) |
|---|---|---|---|---|---|---|---|---|---|---|
| Copper-base alloy | m1 | 2.6 | 12.1 | — | 3.6 | Balance | 1.0 | 2.2 | — | 280 |
| Comparative Mo alloy | t1 | 16.3 | 28.0 | Balance | 18.6 | 19.1 | 4.7 | 3.1 | 13.0 | 600 |
| Hard Mo alloy of the invention | k1 | 16.0 | 24.7 | Balance | 16.4 | 14.6 | 4.2 | 4.1 | 34.0 | 580 |
| Hard Mo alloy of the invention | k2 | 15.6 | 21.2 | Balance | 14.1 | 9.9 | 3.7 | 5.2 | 57.0 | 820 |
| Hard Mo alloy of the invention | k3 | 15.3 | 18.0 | Balance | 12.0 | 5.5 | 3.2 | 6.1 | 79.0 | 1120 |

All the powders thus obtained were in the form of almost sphere. An optical microphotograph (magnification:×580) of microstructure of a section of the hard molybdenum alloy k2 is shown in FIG. 1. FIG. 1 shows that the microstructure of the hard molybdenum alloy k2 comprises a Laves structure silicide (shown white) in an amount of not less than 50 vol-% and a solid solution binding phase (shown gray) comprising Ni, Co, Fe, Cr and Cu.

COMPARATIVE EXAMPLE 1

Figure 2:
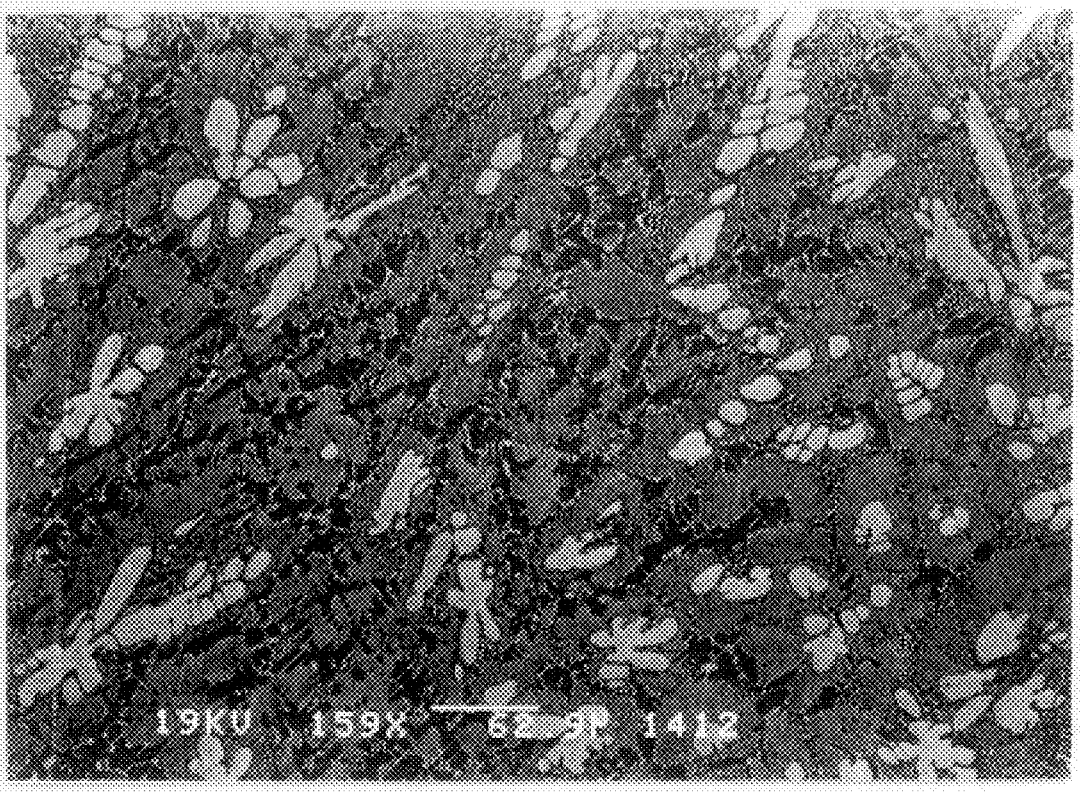
FIG. 2 is an optical microphotograph (magnification:× 180) of the microstructure of a section of the comparative molybdenum alloy t1 used in Comparative Example 1.

Gas atomizing was effected in the same manner as in Example 1 to prepare the comparative molybdenum alloy t1 set forth in Table 1 in the form of powder. The alloy powder thus obtained was in almost spherical form. FIG. 2 is an optical microphotograph (magnification:×180) of microstructure of a section of the alloy. FIG. 2 shows that the microstructure of t1 has a Laves structure silicide in an amount as small as about 13 vol-%.

The hard Mo alloy powders k1, k2 and k3 of Example 1 set forth in Table 1 were each compressed into a column having a diameter of 30 mm and a length of 40 mm under a pressure of 4 ton/cm$^2$ by cold isostatic pressing. The powders thus compressed were each sintered at a temperature of 1,300° C. in a vacuum sintering furnace for 1 hour, and then densified at a temperature of 1,200° C. and a pressure of 120 atm. for 4 hours by a hot isostatic pressing to prepare consolidated hard Mo alloys K1, K2 and K3 according to the present invention.

The alloy powder t1 was then subjected to compression, sintering and hot isostatic pressing in the same manner as described above to prepare a comparative consolidated molybdenum alloy T1.

(Test for Evaluation of Properties)

Figure 3:
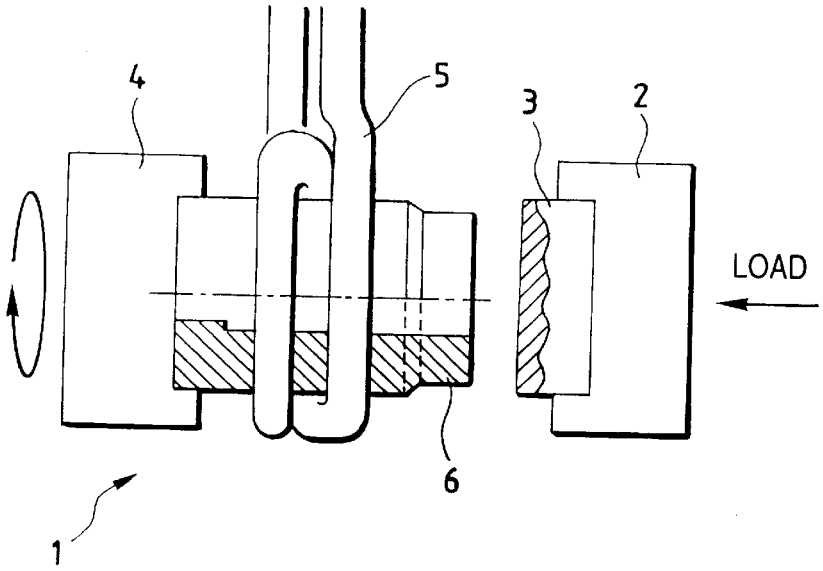
FIG. 3 is a schematic diagram illustrating the high temperature wear testing machine used in the evaluation test of properties of Example 1 of the present invention and Comparative Examples 1, 3 and 4.

The consolidated hard-molybdenum alloys K1, K2 and K3 of Example 1 according to the present invention and the comparative consolidated molybdenum alloy T1 were each evaluated for wear resistance by high temperature frictional wear test. FIG. 3 is a schematic diagram illustrating the testing machine. In the operation of the testing machine 1, a rotating 20 mmϕ columnar mating material 6 (SUH35; 21-4N heat resistant steel), which is rotatably held by a holder 4 and has been heated by a high frequency induction coil 5, is pressed against a block specimen 3 having a size of 25 mm×10 mm×5 mm fixed by a holder 2. The test was effected at a heating temperature of 600° C., a face pressure of 6.5 kgf/cm$^2$, a sliding speed of 0.3 m/s and a sliding distance of 360 m.

Figure 4:
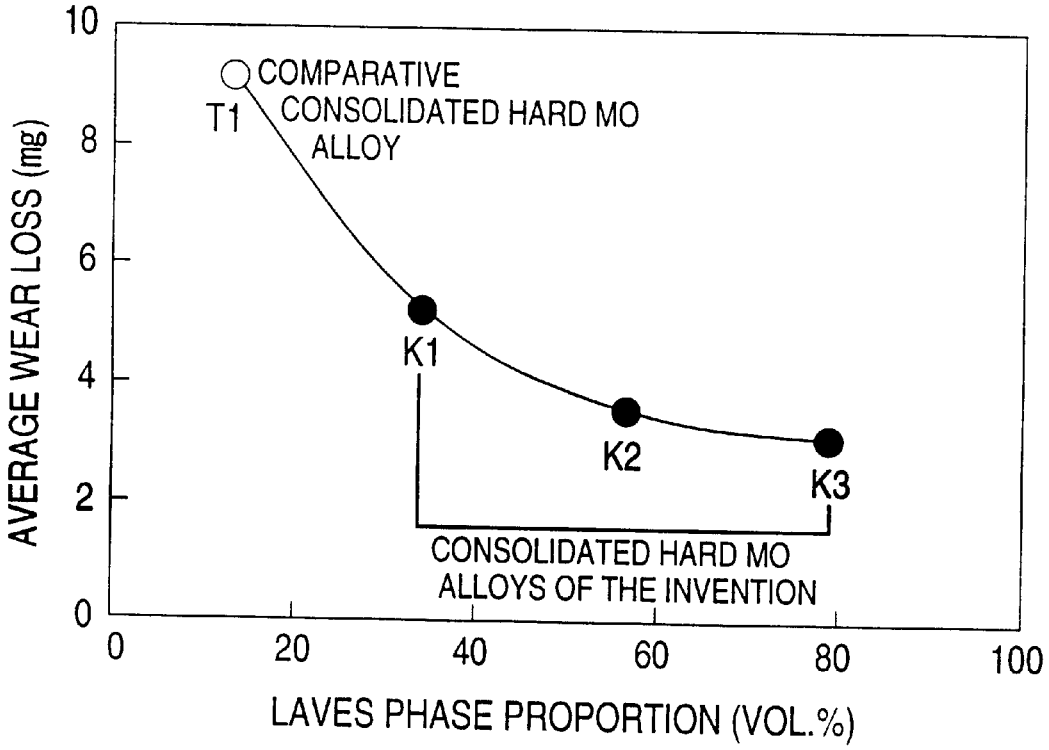
FIG. 4 is a diagram illustrating the results of the evaluation test of properties of Example 1 of the present invention and Comparative Example 1 obtained by a test using the testing machine shown in FIG. 3.

FIG. 4 illustrates the average wear loss of the specimen under the foregoing conditions. These results show that K1, K2 and K3 according to the present invention each exhibit a remarkably small mass loss by wear as compared with the comparative molybdenum alloy T1.

EXAMPLE 2

The hard molybdenum alloys k1 to k3 obtained in Example 1 were each subjected to classification by sieving to obtain a powder having a grain diameter as relatively great as 63 to 106 $\mu$m. These powders were each mixed with the copper-base alloy powder m1 set forth in Table 1 as a metallic matrix powder in an amount such that Vf was 0.2. These mixtures were then stirred by means of a rotary mixer for about 1 hour. These starting material powders were compressed into a column having a diameter of 20 mm under a die press, and then sintered at a temperature of 1,150° C. in a hydrogen atmosphere for 1 hour to prepare wear resistant sintered alloys A1 to A3 according to the present invention.

Figure 5:
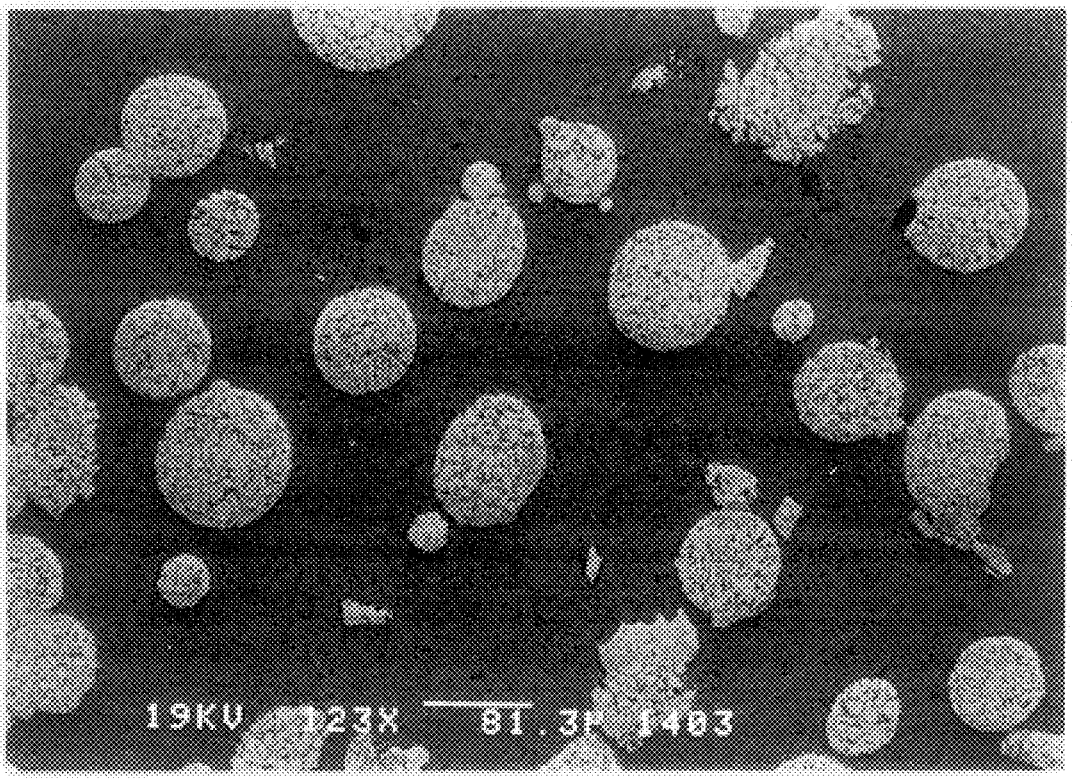
FIG. 5 is an optical microphotograph (magnification:× 150) of the microstructure of a section of the wear resistant sintered alloy A2 obtained in Example 2 of the present invention.

FIG. 5 is an optical microphotograph (magnification:× 150) of the microstructure of a section of the wear resistant sintered alloy A2. FIG. 5 shows that the microstructure comprises a copper alloy as a matrix and spherical hard grains dispersed therein. The average diameter of the grains is almost the same as the grain diameter of the hard molybdenum alloy used. Further, a great amount of Laves structure silicide was observed in the grains. The microstructure of the grains is basically the same as that of the hard molybdenum alloy shown in FIG. 1.

These results show that the incorporation of the hard molybdenum alloy of the present invention as a reinforcing phase makes it possible to obtain a wear resistant sintered alloy comprising hard grains containing a large amount of Laves structure silicide dispersed therein.

COMPARATIVE EXAMPLE 2

The copper-base alloy powder m1 set forth in Table 1 alone was used as a starting material powder. It was compressed, and then sintered in the same manner as described above to prepare a comparative sintered alloy M1.

COMPARATIVE EXAMPLE 3

The powder of the comparative molybdenum alloy t1 obtained in Comparative Example 1 was subjected to classification in the same manner as above. The powder thus classified was then blended with the copper-base alloy powder m1 set forth in Table 1 as a metallic matrix in an amount such that Vf was 0.2. The starting material powder was then subjected to blending, compression and sintering in the same manner as above to prepare a comparative sintered alloy C1.

(Test for Evaluation of Properties)

The wear resistant sintered alloys A1 to A3 of Example 2 according to the present invention and the comparative sintered alloys M1 and C1 of Comparative Examples 2 and 3 were evaluated for wear resistance by a pin-on-disk wear test. In some detail, a columnar pin-shaped specimen having a friction surface with a diameter of 8 mm was pressed against a rotating medium carbon steel disk having a thickness of 2 mm under a load. The load was 1.0 kgf/mm$^2$, the sliding speed was 0.6 m/sec, and the sliding distance was 2,000 m.

Figure 6:
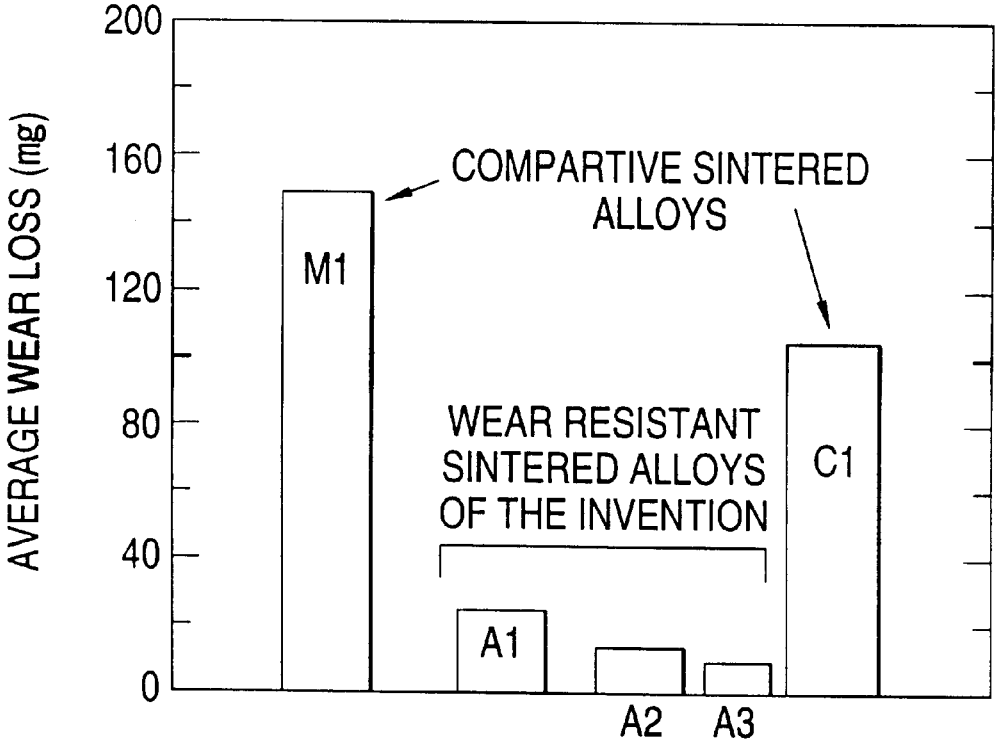
FIG. 6 is a diagram illustrating the results of the evaluation test of properties of Example 2 according to the present invention and Comparative Examples 2 and 3 obtained by a pin-on-disk wear test on the wear resistant sintered alloy.

FIG. 6 illustrates the average wear loss of the specimen under the foregoing conditions. The results show that A1 to A3 of the present invention show a remarkably small mass loss by wear as compared with the comparative sintered alloy M1 free of hard molybdenum alloy.

Further, the comparative sintered alloy C1 doesn't show a remarkably smaller mass loss by wear as compared with the comparative sintered alloy M1 free of hard molybdenum alloy, demonstrating that the comparative molybdenum alloy t1 thus incorporated doesn't make a great contribution to the improvement of wear resistance.

EXAMPLE 3

The hard Mo alloy powders k1, k2 and k3 set forth in Table 1 were each subjected to classification by sieving to obtain a powder having a grain diameter as relatively great as 63 to 106 $\mu$m in the same manner as above. These powders were each mixed with the copper-base alloy powder m1 set forth in Table 1 as a metallic matrix powder in an amount such that Vf was 0.8. These mixtures were then stirred by means of a rotary mixer for about 1 hour. These starting material powders were compressed into a column having a diameter of 30 mm and a length of 40 mm under a pressure of 4 ton/cm$^2$ by cold isostatic pressing, sintered at a temperature of 1,300° C. in a vacuum sintering furnace for 1 hour, and then subjected to densification at a temperature of 1,200° C. by hot isostatic pressing at a pressure of 120 atm for 4 hours to prepare wear resistant sintered alloys B1, B2 and B3 according to the present invention.

COMPARATIVE EXAMPLE 4

The powder t1 was subjected to classification in the same manner as above. The powder thus classified was then mixed with the copper-base alloy powder m1 set forth in Table 1 as a matrix powder in an amount such that Vf was 0.8. The starting material powder thus obtained was then subjected to compression, sintering and hot isostatic pressing to prepare a comparative sintered alloy C2.

(Test for Evaluation of Properties)

The wear resistant sintered alloys B1, B2 and B3 of Example 3 according to the present invention and the comparative sintered alloy C2 obtained in Comparative Example 4 were each evaluated for wear resistance by high temperature frictional wear test in the same manner as in Example 1.

Figure 7:
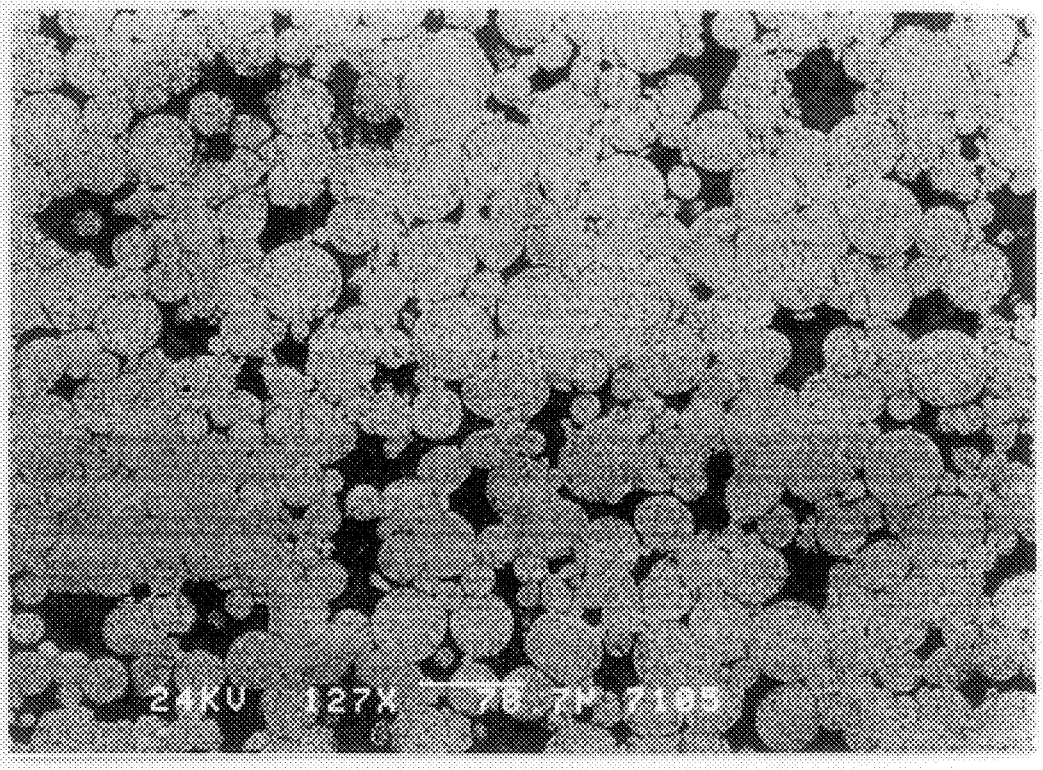
FIG. 7 is an optical microphotograph (magnification:× 150) of the microstructure of a section of the wear resistant sintered alloy B2 obtained in Example 3 of the present invention.
Figure 8:
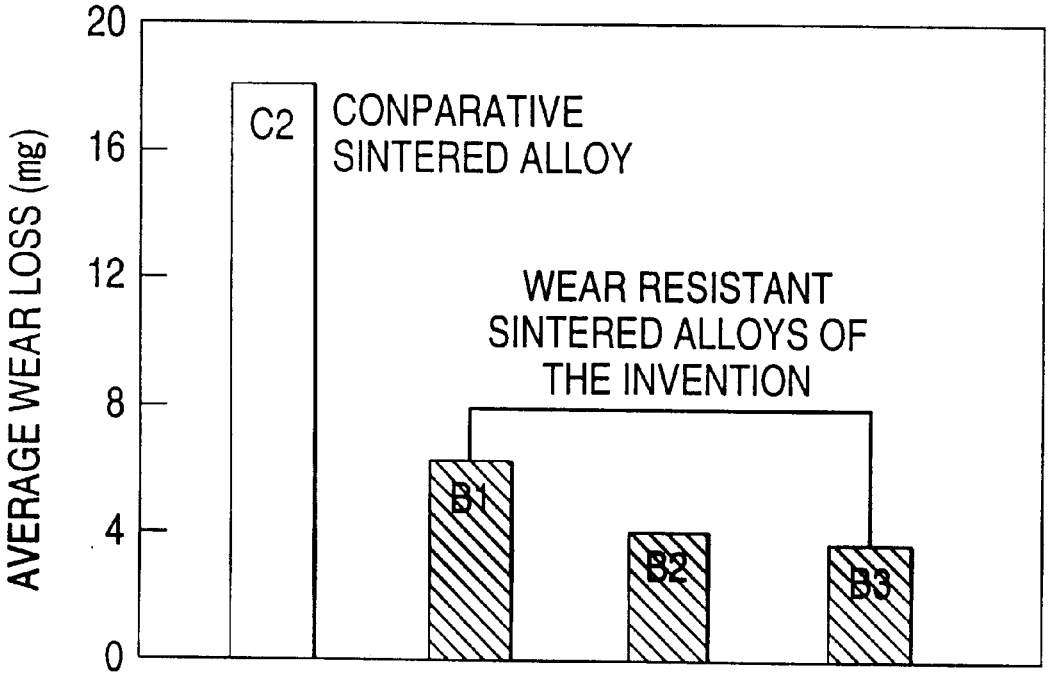
FIG. 8 is a diagram illustrating the results of the evaluation test of properties of Example 3 according to the present invention and Comparative Example 4 obtained by a test using the testing machine shown in FIG. 3.

FIG. 7 illustrates the average wear loss of the specimens under the foregoing conditions. These results show that B1, B2 and B3 according to the present invention exhibit a remarkably small mass loss by wear as compared with the comparative molybdenum alloy C2.

While the invention has been described in detail and with reference to specific embodiments thereof, it will be apparent to one skilled in the art that various changes and modifications can be made therein without departing from the spirit and scope thereof.

What is claimed is:

1. A hard molybdenum alloy, comprising:

cobalt (Co) in an amount of from 14.0 to 43.0% by weight;

silicon (Si) in an amount of from 3.0 to 8.0% by weight; and molybdenum (Mo) in an amount of not less than 20.0% by weight based on the total weight of the hard molybdenum alloy.

2. The hard molybdenum alloy according to claim 1, wherein the content of molybdenum (Mo) falls within the range of from 25.0 to 70.0% by weight.

3. The hard molybdenum alloy according to claim 2, wherein the content of molybdenum (Mo) falls within the range of from 30.0 to 50.0% by weight.

4. The hard molybdenum alloy according to claim 1, wherein Mo and Si satisfies the following relationship in weight fraction:

$5.5<(Mo/Si)>5.5$.

5. The hard molybdenum alloy according to claim 1, comprising a silicide having a Laves structure and a solid solution binding phase including at least one of Ni and Co.

6. The hard molybdenum alloy according to claim 1, further comprising at least one selected from the group consisting of tungsten (W), niobium (Nb), vanadium (V), hafnium (Hf) and tantalum (Ta) in a total amount of not more than 50.0% by weight of the remainder of the alloy excluding Ni, Co and Si.

7. The hard molybdenum alloy according to claim 1, further comprising at least one selected from the group consisting of iron (Fe), copper (Cu) and chromium (Cr) in a total amount of from 5.0% by weight to 55.0% by weight.

8. The hard molybdenum alloy according to claim 7, further comprising at least one selected from the group consisting of tungsten (W), niobium (Nb), vanadium (V), hafnium (Hf) and tantalum (Ta) in a total amount of not more than 50.0% by weight of the remainder of the alloy excluding Ni, Co, Si, Fe, Cu and Cr.

9. The hard molybdenum alloy according to claim 7, wherein the total content of at least one of Fe, Cu and Cr is from 10.0% by weight to 33.0% by weight.

10. The hard molybdenum alloy according to claim 9, wherein the total content of at least one of Fe, Cu and Cr is from 12.0% by weight to 25.0% by weight.

11. The hard molybdenum alloy according to claim 1, wherein the total content of at least one of nickel (Ni) and cobalt (Co) is from 20.0% by weight to 40.0% by weight.

12. The hard molybdenum alloy according to claim 11, wherein the total content of at least one of nickel (Ni) and cobalt (Co) is from 26.0% by weight to 38.0% by weight.

13. The hard molybdenum alloy according to claim 1, wherein the content of silicon (Si) is from 4.0% by weight to 6.5% by weight.

14. The hard molybdenum alloy according to claim 13, wherein the content of silicon (Si) is from 4.5% by weight to 6.2% by weight.

15. A wear resistant alloy comprising a metallic matrix and a hard molybdenum alloy incorporated in said metallic matrix, wherein said hard molybdenum alloy comprises cobalt (Co) in an amount of from 14.0 to 43.0% by weight, silicon (Si) in an amount of from 3.0 to 8.0% by weight and molybdenum (Mo) in an amount of not less than 20.0% by weight based on the total weight of the hard molybdenum alloy.

16. The wear resistant alloy according to claim 15, wherein said metallic matrix comprises at least one metal selected from the group consisting of iron, copper and nickel, and an alloy mainly composed thereof.

17. The wear resistant alloy according to claim 15, wherein the content of said hard molybdenum alloy is from 0.05 to 0.7 as calculated in terms of volume fraction.

18. A wear resistant sintered alloy obtained by sintering a mixture of a metallic matrix powder and a hard molybdenum alloy powder, wherein said hard molybdenum alloy powder comprises cobalt (Co) in an amount of from 14.0 to 43.0% by weight, silicon (Si) in an amount of from 3.0 to 8.0% by weight and molybdenum (Mo) in an amount of not less than 20.0% by weight and said hard molybdenum alloy is incorporated in said metallic matrix as a reinforcing phase.

19. A method for manufacturing a wear resistant sintered alloy comprising:

preparing a metallic matrix powder or a blended elemental powder constituting said metallic matrix;

preparing a hard molybdenum alloy powder;

preparing a mixture of said metallic matrix powder or said blended elemental powder and said hard molybdenum alloy powder; and sintering said mixture, wherein said hard molybdenum alloy powder comprises cobalt (Co) in an amount of from 14.0 to 43.0% by weight, silicon (Si) in an amount of from 3.0 to 8.0% by weight and molybdenum (Mo) in an amount of not less than 20.0% by weight based on the total weight of the hard molybdenum alloy, and said wear resistant sintered alloy comprises a metallic matrix and a hard molybdenum alloy incorporated in said metallic matrix as a reinforcing phase.

20. The hard molybdenum alloy according to claim 1, further comprising nickel (Ni) in a total amount of Co and Ni of from 14.0 to 43.0% by weight.

21. A hard molybdenum alloy, comprising:

at least one of nickel (Ni) and cobalt (Co) in a total amount of from 14.0 to 43.0% by weight;

silicon (Si) in an amount of from 3.0 to 8.0% by weight;

molybdenum (Mo) in an amount of not less than 20.0% by weight based on the total weight of the hard molybdenum alloy; and at least one selected from the group consisting of tungsten (W), niobium (Nb), vanadium (V), hafnium (Hf) and tantalum (Ta) in a total amount of not more than 50.0% by weight of the remainder of the alloy excluding Ni, Co and Si.

22. A wear resistant-alloy comprising a metallic matrix and a hard molybdenum alloy incorporated in said metallic matrix, wherein said hard molybdenum alloy comprises at least one of nickel (Ni) and cobalt (Co) in an amount of from 14.0 to 43.0% by weight, silicon (Si) in an amount of from 3.0 to 8.0% by weight, molybdenum (Mo) in an amount of not less than 20.0% by weight based on the total weight of the hard molybdenum alloy, and the content of said hard molybdenum alloy is from 0.05 to 0.7 as calculated in terms of volume fraction.

23. The wear resistant alloy according to claim 15, wherein said hard molybdenum alloy further comprises nickel (Ni) in a total amount of Co and Ni of from 14.0 to 43.0% by weight.

24. The wear resistant sintered alloy according to claim 18, wherein said hard molybdenum alloy powder further comprises nickel (Ni) in a total amount of Co and Ni of from 14.0 to 43.0% by weight.

25. The method according to claim 19, wherein said hard molybdenum alloy powder further comprises nickel (Ni) in a total amount of Co and Ni of from 14.0 to 43.0% by weight.

* * * * *

UNITED STATES PATENT AND TRADEMARK OFFICE

CERTIFICATE OF CORRECTION

PATENT NO. : 6,066,191

DATED : May 23, 2000

INVENTOR(S): Kouji TANAKA et al

It is certified that an error appears in the above-identified patent and that said Letters Patent is hereby corrected as shown below:

Column 18, line 7, Claim 4, "5.5<(Mo/Si)>5.5." should read --5.5<(Mo/Si).--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*